US008438673B2

(12) United States Patent
Bell

(10) Patent No.: US 8,438,673 B2
(45) Date of Patent: May 14, 2013

(54) REMOVABLE AND INTERCHANGEABLE SOAP DISH AND/OR OTHER BATHROOM FIXTURES ASSEMBLY

(76) Inventor: Frederica Fay Bell, New Castle, PA (US)

( * ) Notice: Subject to any disclaimer, the term of this patent is extended or adjusted under 35 U.S.C. 154(b) by 1409 days.

(21) Appl. No.: 11/779,927

(22) Filed: Jul. 19, 2007

(65) Prior Publication Data

US 2008/0016615 A1 Jan. 24, 2008

Related U.S. Application Data

(60) Provisional application No. 60/832,669, filed on Jul. 22, 2006.

(51) Int. Cl.
*A47K 1/04* (2006.01)

(52) U.S. Cl.
USPC ..... 4/628

(58) Field of Classification Search ... 4/628; 211/85.12, 211/119.009; 248/220.21, 221.11, 223.41, 248/224.51, 224.7, 224.8
See application file for complete search history.

(56) References Cited

U.S. PATENT DOCUMENTS 1,709,144 A * 4/1929 Mueller ..... 248/222.11
4,240,129 A * 12/1980 Kawazoe ..... 362/3
5,597,280 A * 1/1997 Stern ..... 411/508
5,662,375 A * 9/1997 Adams et al. ..... 296/214
5,894,612 A * 4/1999 Wilson ..... 4/605
6,106,055 A * 8/2000 Fischer ..... 296/214
6,196,504 B1 * 3/2001 Lemke ..... 248/187.1
6,418,574 B2 * 7/2002 McDowell ..... 4/606
6,422,520 B1 * 7/2002 Hand ..... 248/65
6,432,505 B1 * 8/2002 Sweenie et al. ..... 428/92
6,789,832 B2 * 9/2004 Gort et al. ..... 296/37.8
6,935,518 B2 * 8/2005 Winig et al. ..... 211/90.02
7,353,957 B2 * 4/2008 Winig et al. ..... 211/59.1
7,354,024 B2 * 4/2008 Winig et al. ..... 248/220.22
2002/0011543 A1 * 1/2002 Chinn et al. ..... 248/121
2005/0236533 A1 * 10/2005 McRight et al. ..... 248/161

* cited by examiner

*Primary Examiner* — Lori Baker
(74) *Attorney, Agent, or Firm* — Richard Mark Blank, Esq.

(57) ABSTRACT

A removable and interchangeable soap dish and/or other fixture which has a wall mount segment having a male connector with screw holes. The mount is L-shaped with the wall side and connector both rectangular shaped and connected perpendicularly. Protruding out from the mount and perpendicular to the male connector is a handle. The mount is attached to any wall using standard screws which fit into the screw holes. A female slot which is shaped and designed to receive the male connector is molded inside the fixture. A securing devise at the end of the slot allows the male end to slide in then lock into place. Attach the fixture to the wall mount by lining up the female slot and male connector and apply pressure to push them together. The locking device is deactivated by applying minimum pressure to the fixture as it is pulled away from the mount.

6 Claims, 5 Drawing Sheets

REMOVABLE AND INTERCHANGEABLE SOAP DISH AND/OR OTHER BATHROOM FIXTURES ASSEMBLY

RELATED APPLICATIONS

The present application claims the benefit under 35 U.S.C. §119(e) of the U.S. provisional application(s) listed here as 60/832,669 filed on Jul. 22, 2006 titled "Decorator's delight", included by reference herein and for which benefit of the priority date is hereby claimed. This application claims the benefit under 35 U.S.C. §119(e) of the U.S. provisional application(s) listed here as 60/832,669 filed on Jul. 22, 2006 titled "Decorator's delight".

FIELD OF THE INVENTION

The present invention relates to bathroom decorating accessories and fixtures and, more particularly, to devices with both a male and female connector that affix bathroom fixtures and accessories such as soap dishes, toothbrush and cup holders, switch plates, towel bars and holders, towel hooks, tissue holders and other bathroom fixtures and accessories to the walls of the room and allow for quick and easy interchangeability between a variety of choices and styles of fixtures and accessories.

BACKGROUND OF THE INVENTION

Home renovations are very costly and time consuming If you have contractors doing the work you need to select them and work on their schedule availabilities which hopefully meet yours.

Usually they work at their pace and not yours and their presence in your home displaces you from the areas of work and it is uncomfortable for you.

If you are doing the work yourself then commonly there is an education factor needed on your part to perform the tasks correctly. You also usually need to purchase and be able to use several tools necessary to perform the tasks. The materials need to be purchased which also takes time and money. In either case there is a chance things will get damaged in the process, or the renovation will fail or not be done properly and have to be either partially or fully redone at more time and expense.

The Bathroom is usually one of the most costly, time consuming, and difficult renovations in comparison to other rooms located in a typical home. Commonly items located in the bathroom that get tremendous use and have significant wear and tear are soap dishes, toothbrush and cup holders, switch plates, towel bars, towel hooks, toilet: paper holders, and tissue holders. These items usually are required to be secured well to the walls of the bathroom. Therefore replacement is a serious renovation as there are usually significant holes, cracks, and brakes in the walls left over when removing these items. Usually the walls have to be repaired, primed, as well as, painted and new fixtures have to be purchased. Education is required in installing particular fixtures, and tools and special fasteners may be required to be purchased, etc. Sometimes the new materials and fixtures purchased are defective or parts break during this replacement process adding to the difficulties and expense in the process.

There are several reasons for requiring replacement of the bathroom fixtures. Wear and tear of these fixtures will usually cause frequent discoloring, and breakage. An additional problem with the usual bathroom fixtures is that the continued use causes mold, germs, and bacteria to build-up on these fixtures requiring eventual replacement. Finally, decor is also important. People like to make style, pattern, and size changes to all the items that are not permanently affixed in the bathroom such towels, toilet paper, tissues, countertop tissue dispensers, counter top cup and toothbrush holders, cups, counter top soap dishes, etc. While we would like to coordinate these items with, and make changes to, affixed items the above, hurtle cause us to most of the time not make these changes.

While the original solution to these problems was to use countertop products purchased at the store, like countertop tissue dispensers, countertop cup and toothbrush holders, cups, counter top soap dishes, and counter top towel holders, as well as, free standing units for toilet paper roll holders, towel racks, etc., these solutions are very limiting in that these items quickly take up all your countertop and floor space and begin to make your bathroom look cluttered.

Also these items tend to be less permanent and less long lasting in nature.

The present invention could be offered in a variety of colors, patterns, shapes, sizes, styles, materials, and looks and therefore offers the better solution as they will not clutter up your countertops, not take up important floor space and last longer. The present device is less costly then the counter top method as these items will be more permanent and be able to be stored when not in use therefore you can reuse these items when ready for change again. Some of the materials that can be used to make the fixtures in the present devise are glass, wood, metal, brass, gold, silver, steel, plastic, marble, stone, and porcelain. These products made for the current device could be made extremely durable, and moisture-resistant, in the preferred embodiment.

The counter top and floor items are usually made by a variety of makers in a variety of materials, patterns, colors, and styles that are not usually planned to specifically match, and therefore don't necessarily match perfectly, or even work together in decorating schemes. This device can have many precisely coordinated pieces and sets to better serve the decorating needs of the person designing the bathroom decor, and can accommodate traditional, contemporary and many types of styles of bathroom decor.

This device gives homeowners and others the flexibility to change the appearance of their bathroom easily at any time.

Additionally this device can be used in other rooms throughout the house, office, or on walls and other surfaces in any type of home, building, dwelling, lodging, storage unit, garage, basement, or inside space.

It is therefore an object of the invention to enable a user to change bathroom decor quickly, easily, conveniently, and cost effectively. It is another object of the invention to eliminate the need for tools, fasteners, or remodeling work.

It is another object of the invention to change the look of a bathroom without the cost of remodeling.

It is another object of the invention to allow for interchangeable bathroom fixtures that are offered in a variety of styles, shapes, patterns, colors, and materials to suit any preference.

It is another object of the invention to allow for interchangeable bathroom fixtures that can be purchased and used in connection with each other as coordinating pieces.

It is another object of the invention to accommodate traditional, contemporary and other styles of bathroom decor.

It is another object of the invention to feature durable, moisture-resistant construction.

It is another object of the invention to give homeowners and others the flexibility to change the appearance of their bathroom, easily, cost effectively, quickly, and anytime.

It is another object of the invention to reduce the need to undertake extensive and costly home-improvement projects.

It is another object of the invention to make accessible a better way to address your personal decorating needs.

It is another object of the invention to coordinate soap dishes, cup and toothbrush holders, switch plates, towel hooks, towel bars, tissue holders, toilet paper holders, and other bathroom fixtures.

It is another object of the invention to increase the users' usable counter space and floor space, by making fixtures more appealing to use, as oppose to the use of stand allow items.

It is another object of the invention to offer bathroom accessories in a variety of materials such as glass, wood, porcelain marble, stone, plastic, rubber, and a wide range of metals, gold, brass, silver, and stainless steel.

It is another object of the invention to offer bathroom accessories and fixtures in round, square, rectangular, oval-shaped and other shapes and forms with a variety of edges such as scalloped edges, straight edges, curved edges, etc.

It is another object of the invention to incorporate a handle in the front of a soap dish to be used for interchanging and connecting other bathroom items and fixtures such as towel bars and issue boxes.

It is another object of the invention to provide a more decorative, neat, and professional look in any bathroom.

SUMMARY OF THE INVENTION

In accordance with the present invention, there is provided a molded universal wall mount with a flexible tab shaped male connector and this wall mount also having screw holes cut into it. The screw holes have been properly sized and measured to securely fit the accompanying wall mount screws. This wall mount is L-shaped with a wall mounting portion that is rectangularity shaped, and a flexible tab male connector that is also rectangular shaped, and connected perpendicularly to the wall mounting side of the wall mount. The wall mount is of a depth or thickness that is both thin but sturdy and strong on both the wall mounting side and the flex tab male connector. Also protruding out in a continuing manor, straight from the wall mounting side, and perpendicular to the male connector side is a three sided handle with two curved corners and a tubular form. The wall mount is secured and tightened into place on top of any wall or other surface using standard wall mount screws which have been correctly sized and measured to properly fit into the screw holes in the wall mount and each screw with length enough to be secured into the wall or other surface. A female receiving end which is shaped and designed to receive the male end of the wall mount is positioned inside of the variety or fixtures to choose from, that can be attached securely to the wall mount. Each fixture has the female receiving end molded into it as a female internal slot which is part thereof the fixture. There is a one way securing devise at the outer end of the female slot within the receiving fixture that allows the male end to slide on then locks it into place for secure and safe fitting. To attach the fixture to the wall mount the user simply lines up the female slot and the male connector and applies minimum pressure to push the two together against the wall or other surface. The locking device is easily deactivated by the user applying minimum pressure upon the fixture is it is pulled away from the wall mount. There is additionally a push button, for exerting pressure on the flex tab male connector to help secure it in place within the female connector, insertably connected to the female connector; and a spring, for forcing the push button to stay down in place exerting pressure on the top part of the flex tab male connector to help secure it in place within the female connector, externally connected to said push button.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
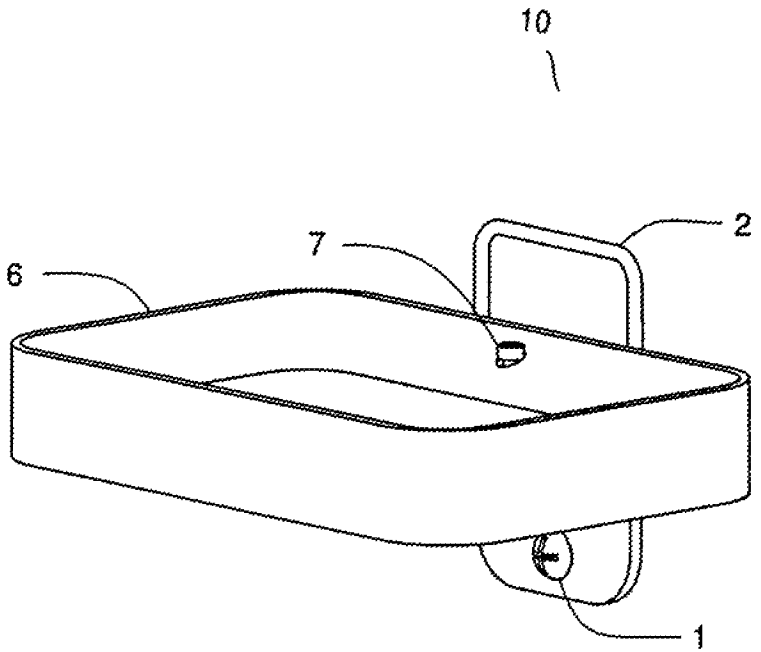
FIG. 1 is a front view of a removable and interchangeable soap dish and/or other bathroom fixtures assembly.

FIG. 1 is a front view of a removable and interchangeable soap dish and/or other bathroom fixtures assembly.

Figure 2:
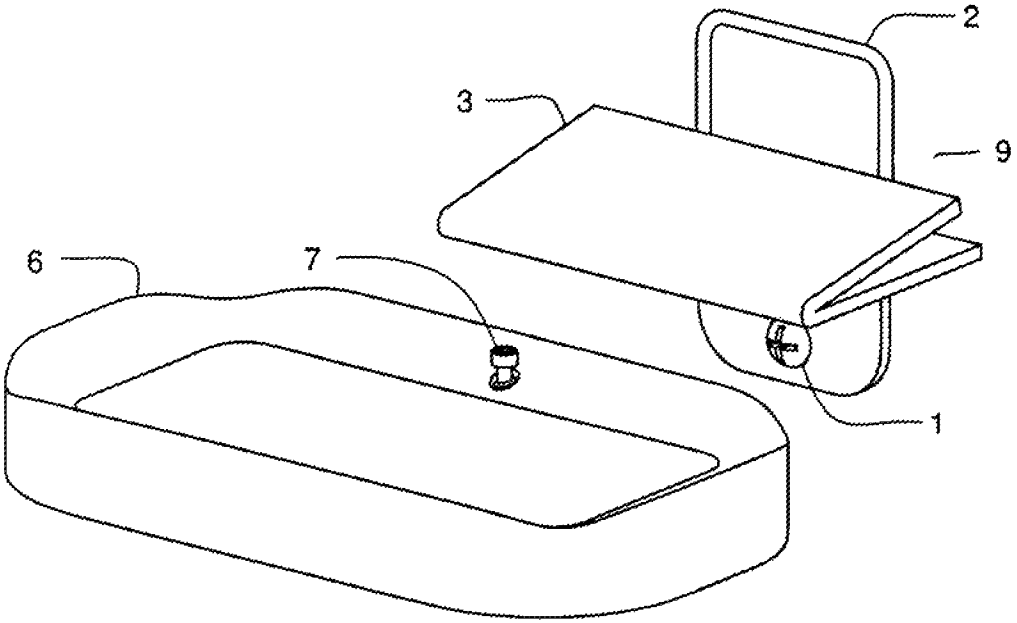
FIG. 2 is a front view of a removable and interchangeable soap dish and/or other bathroom fixtures assembly with the male and female portions shown separated and unattached for a more complete view of each of the two segments.

FIG. 2 is a front view of a removable and interchangeable soap dish and/or other bathroom fixtures assembly with the male and female portions shown separated and unattached for a more complete view of each of the two segments.

Figure 3B:
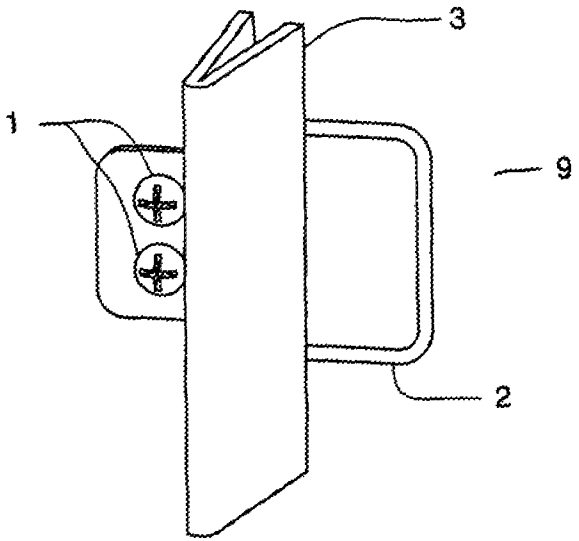
FIG. 3B is a front side view of a wall mount which is the male portion of the removable and interchangeable soap dish and/or other bathroom fixtures assembly which highlights the bottom area used for placement of the wall mount screws and the wall mount screws. It is also turned at a right angle to show the flex tab wall mount situated to be used vertically, as well as, the horizontally shown version in FIG. 3A.
Figure 3A:
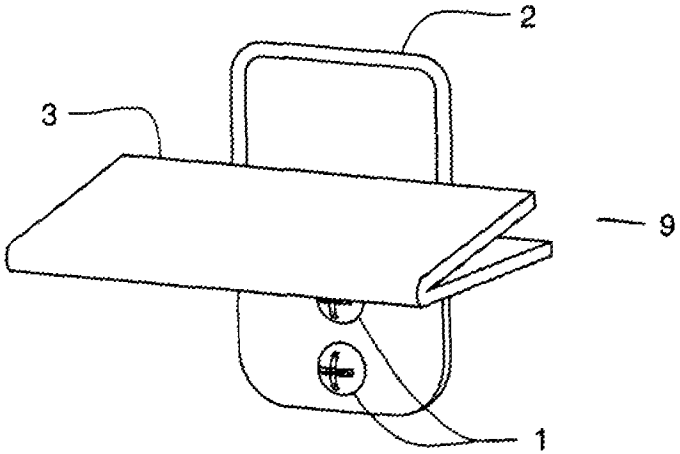
FIG. 3A is a front close-up view of a wall mount which contains the male portion of the removable and interchangeable soap dish and/or other bathroom fixtures assembly as well as the wall mount handle.

FIG. 3A is a front close-up view of a wall mount ( ) which contains the male portion of the removable and interchangeable soap dish and/or other bathroom fixtures assembly as well as the wall mount handle (2).

FIG. 3B is a front side view of a wall mount (9) which is the male portion of the removable and interchangeable soap dish and/or other bathroom fixtures assembly which highlights the bottom area used for placement of the wall mount screws (1) and the wall mount screws (1). It is also turned at a right angle to show the flexible wall mount situated to be used vertically, as well as, the horizontally shown version in FIG. 3A.

Figure 4:
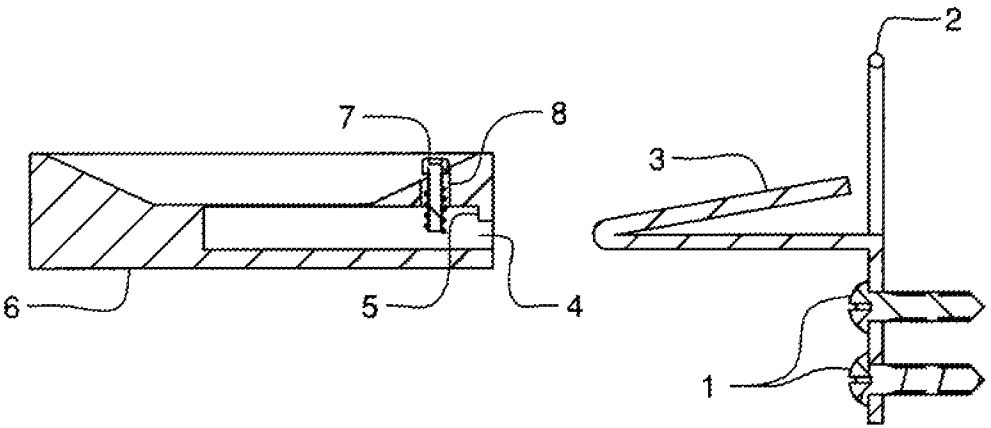
FIG. 4 is a detailed side cutaway view of a removable and interchangeable soap dish and/or other bathroom fixtures assembly with the two sections, male and female, separated for a more complete view of both complete segments.

FIG. 4 is a detailed side cutaway view of a removable and interchangeable soap dish and/or other bathroom fixtures assembly with the two sections, male and female, separated for a more complete view of both complete segments.

Figure 5:
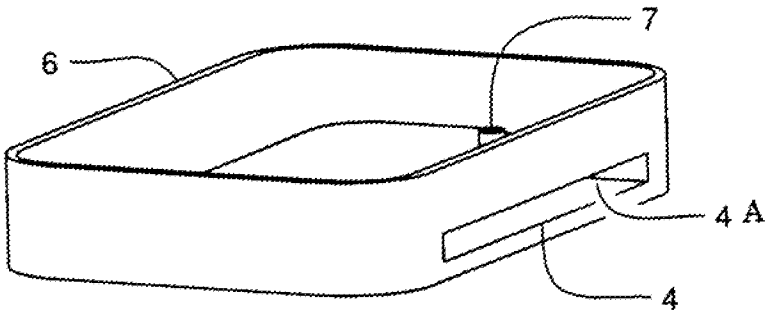
FIG. 5 is a left detail view of a bathroom fixture assembly which contains the female portion of the removable and interchangeable soap dish and/or other bathroom fixtures assembly.

FIG. 5 is a left detail view of a bathroom fixture (6) assembly which contains the female portion of the removable and interchangeable soap dish and/or other bathroom fixtures assembly.

Referring to FIGS. 1 through 5, which show a removable and interchangeable soap dish and/or other bathroom fixtures assembly which features two primary segments, one a male section which has a strong, sturdy wall mount (9) (also wall mount (9) is the entire FIG. 3A and also entire FIG. 3B), as well as, a flex tab male connector (3) which attaches to a bathroom fixture (6) and the other segment being a bathroom fixture (6). The preferred embodiment has two screw holes cut into the wall mount (9) while the wall mount (9) could have four or more holes cut into the wall mount (9) which fit wall mount screws (1) which are slid through these openings and held securely in place when the head of the screws rest against the outer rim of the screw holes which are located on the wall mount (9). The wall mount screws (1) are of a length which penetrate the wall or other surface (10) deep enough to tightly secure the wall mount (9) to the wall or other surface (10). The wall mount (9) is L-shaped with a wall mounting portion that is rectangularity shaped and a flex tab male connector (3) that is also rectangular shaped and connected perpendicularly to the wall mounting side of the wall mount (9). Also protruding out in a continuing manor, straight from the wall mounting side, and perpendicular to the flex tab male connector (3) is a three sided wall mount handle (2) with two curved corners and a tubular form.

A female receiving end or female connector (4) which is shaped and designed to receive the flex tab male connector end (3) of the wall mount (9), is positioned inside of the bathroom fixture (6), so that the female connector (4) can be attached securely to the wall mount (9) by attaching to the flex tab male connector (3). Each bathroom fixture (6) has the female connector (4) receiving end molded into it as a female slot (4*a*) which is part thereof the bathroom fixture (6). There is a one way securing device (5) at the outer end of the female connector (4) within the receiving fixture that allows the flex tab male connector (3) to slide in, then locks it into place for secure and safe fitting. To attach the fixture to the wall mount (9) the user simply lines up the female slot (4*a*) and the flex tab male connector (3) and applies minimum pressure to push the two together against the wall or other surface (10). The securing device (5) is easily deactivated by lifting the push button (7) and spring (8) mechanism which acts like a pressure lock until deactivated and simultaneously as the user also applies minimum pressure upon the fixture as it is pulled away from the wall mount (9).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A removable and interchangeable bathroom fixture assembly comprising:

a wall mount for securing the assembly to a wall or other surface;

the wall mount having a male connector perpendicularly molded to the wall mount;

the wall mount having a handle molded to the wall mount;

a securing device for securing the wall mount to a wall or other surface;

a bathroom fixture having a female connector to attach the fixture to the male connector of the wall mount, the female connector being integrally embedded in the bathroom fixture and having a slot to receive the male connector;

a one way securing device on the female connector at the outer end of the slot of the bathroom fixture for preventing the male connector from disconnecting from the female connector to attach the bathroom fixture to the wall mount; and a push button and spring mechanism within the female connector, a portion of the push button being located on the outside of the female connector, for exerting pressure on the male connector to help secure it in place within the female connector.

2. The removable and interchangeable bathroom fixture assembly of claim 1, wherein the male connector is a flexible flex tab male connector.

3. The removable and interchangeable bathroom fixture assembly of claim 1, wherein the handle is tubular shaped with curved corners.

4. The removable and interchangeable bathroom fixture assembly of claim 1, wherein the securing device for securing the wall mount to a wall or other surface is one or more screws.

5. The removable and interchangeable bathroom fixture assembly of claim 1, wherein the female connector is a slot located internally within the bathroom fixture.

6. The removable and interchangeable bathroom fixture assembly of claim 1, wherein the bathroom fixture is a soap dish, toothbrush holder, cup holder, switch plate, towel holder, or tissue holder.

* * * * *